US008240515B2

(12) United States Patent
Kinzie et al.

(10) Patent No.: US 8,240,515 B2
(45) Date of Patent: Aug. 14, 2012

(54) LOCKABLE PULSER ENCLOSURE FOR USE IN A FUEL DISPENSER

(75) Inventors: Robert A. Kinzie, High Point, NC (US); Vedamurthy Mallikarjunaswamy, Greensboro, NC (US)

(73) Assignee: Gilbarco Inc., Greensboro, NC (US)

( * ) Notice: Subject to any disclaimer, the term of this patent is extended or adjusted under 35 U.S.C. 154(b) by 431 days.

(21) Appl. No.: 12/537,457

(22) Filed: Aug. 7, 2009

(65) Prior Publication Data

US 2009/0314804 A1 Dec. 24, 2009

Related U.S. Application Data

(60) Provisional application No. 61/087,085, filed on Aug. 7, 2008.

(51) Int. Cl.
*B67B 1/00* (2006.01)

(52) U.S. Cl. ... 222/153.01; 222/71; 222/75; 222/153.09

(58) Field of Classification Search ..... 222/153.01, 222/71, 153.09, 75, 74
See application file for complete search history.

(56) References Cited

U.S. PATENT DOCUMENTS 4,410,949 A * 10/1983 Huellinghorst et al. ..... 705/413
4,521,895 A * 6/1985 Wells ..... 377/21
4,986,445 A * 1/1991 Young et al. ..... 222/71
6,908,014 B1 6/2005 Glover

* cited by examiner

*Primary Examiner* — Frederick C. Nicolas
(74) *Attorney, Agent, or Firm* — Nelson Mullins Riley & Scarborough, LLP

(57) ABSTRACT

A lockable enclosure for protecting a pulser of a fuel dispenser including a pulser shaft connecting the pulser to a fuel meter, the enclosure having a first enclosure portion attached to the fuel meter, the first enclosure portion including a base wall, a top wall, a bottom wall, a rear wall, a front wall, a first locking plate extending outwardly from the front wall and a mounting aperture defined by the rear wall. A second enclosure portion is detachably mounted to the first enclosure portion, the second enclosure portion including an outer wall, a top wall, a bottom wall, a rear wall, a front wall, a second locking plate extending outwardly from the front wall and a mounting pin extending inwardly from the rear wall. When the mounting pin of the second enclosure portion is removably received in the mounting aperture defined by the rear wall of the first enclosure portion and the first and second locking plates are adjacent each other to enclose the pulser and pulser shaft within the enclosure.

24 Claims, 11 Drawing Sheets

LOCKABLE PULSER ENCLOSURE FOR USE IN A FUEL DISPENSER

CLAIM OF PRIORITY

The present invention claims priority to U.S. Provisional Patent Application No. 61/087,085, entitled "Locking Pulser Cover," filed Aug. 7, 2008, the entire disclosure of which is incorporated by reference.

FIELD OF THE INVENTION

The present invention relates generally to fuel dispensers. More particularly, the present invention relates to a lockable enclosure for protecting the flow measuring pulser of a fuel dispenser which reports the amount of fuel being dispensed and thus the calculation of the amount of payment due for the dispensed fuel.

BACKGROUND OF THE INVENTION

Many existing fuel dispensers include a device known as a pulser that measures the amount of fuel being dispensed into a vehicle so a proprietor may be properly compensated by the purchaser. The pulser is typically connected to a fuel meter within the fuel dispenser by a pulser shaft so that the pulser can generate electrical signals that are related to the amount of fuel being dispensed. A known method of stealing fuel includes gaining access to the interior of a fuel dispenser and either disabling the pulser or retarding the rotation of the pulser shaft as fuel is being dispensed. In so doing, the fuel being dispensed either goes unreported to the proprietor or the amount reported is less than the actual amount.

Covers have been designed in an attempt to prevent access to the pulser and pulser shaft. For example, a known cover design, such as shown in U.S. Pat. No. 6,908,014, has a long side wall that attaches directly to the meter housing via threaded fasteners. While this design can sometimes provide reasonable protection, it has been overcome by determined thieves. For example, the cover can be readily defeated merely by removing the fasteners that secure it in place. In this regard, efforts have been made to cover the fasteners with a locking mechanism, but thieves have broken these covers so as to access the fasteners for removal. Moreover, even when properly installed, this cover does not fully enclose the pulser and the pulser shaft. Such gaps allow the pulser and pulser shaft to be accessed and disabled using a slender tool or object.

The present invention recognizes and addresses the foregoing considerations, and others, of prior art constructions and methods.

SUMMARY OF INVENTION

One embodiment of the present invention provides a lockable enclosure for protecting a pulser of a fuel dispenser having a pulser shaft connecting the pulser to a fuel meter for measuring and reporting the amount of fuel being measured, the enclosure including a first enclosure portion fixedly mounted within the fuel dispenser adjacent to the fuel meter (either directly or via an intervening backing plate), the first enclosure portion including a base wall, a top wall, a bottom wall, a rear wall, a front wall, a first locking plate extending outwardly from the front wall and at least one mounting aperture defined by the rear wall. A second enclosure portion is detachably mounted to the first enclosure portion, the second enclosure portion including an outer wall, a top wall, a bottom wall, a rear wall, a front wall, a second locking plate extending outwardly from the front wall and at least one mounting pin extending inwardly from the rear wall. When the mounting pin of the second enclosure portion is removably received in the mounting aperture defined by the rear wall of the first enclosure portion and the first locking and second locking plates are adjacent each other, the pulser and pulser shaft are enclosed.

Another embodiment of the present invention provides a lockable enclosure for protecting a pulser of a fuel dispenser having a pulser shaft connecting the pulser to a fuel meter for measuring and reporting the amount of fuel being measured, the enclosure including a first enclosure portion fixedly mounted within the fuel dispenser adjacent to the fuel meter housing, the first enclosure portion including a base wall defining an opening, a first locking plate extending outwardly from the first enclosure portion and a mounting aperture defined by the first enclosure portion. A second enclosure portion is detachably mounted to the first enclosure portion, the second enclosure portion including an outer wall, a second locking plate extending outwardly from the second enclosure portion and a mounting pin disposed on the second enclosure portion. When the mounting pin of the second enclosure portion is removably received in the mounting aperture defined by the first enclosure portion and the first locking and second locking plates are adjacent each other, the pulser and pulser shaft are enclosed.

Another embodiment of the present invention provides a lockable enclosure for protecting a pulser of a fuel dispenser having a pulser shaft connecting the pulser to a fuel meter for measuring and reporting the amount of fuel being measured, the enclosure including a base plate fixedly mounted within the fuel dispenser adjacent to the fuel meter, the first enclosure portion mounted on the base plate, and the first enclosure portion including a base wall defining and opening. A second enclosure portion is mounted on the first enclosure portion. The second enclosure portion is detachably secured to the first enclosure portion to enclose the pulser and pulser shaft within the enclosure.

The accompanying drawings which are incorporated in and constitute a part of this specification, illustrate one or more embodiments of the inventions of this application, and together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1A:
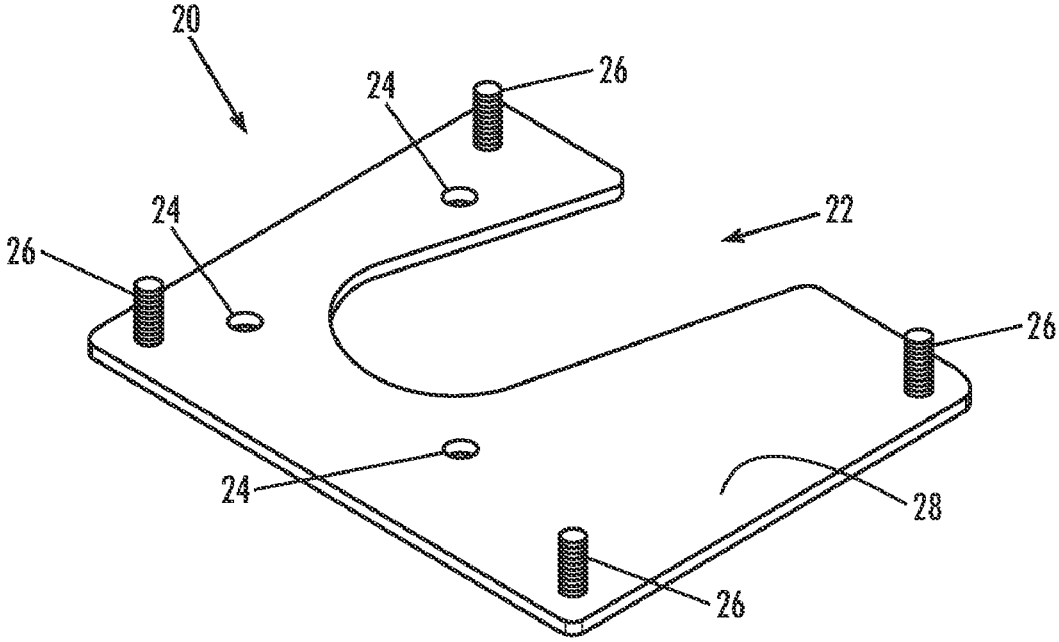
FIGS. 1A, 1B and 1C are perspective views of various components of an embodiment of a lockable enclosure in accordance with the present inventions.

Repeat use of reference characters in the present specification and drawings is intended to represent same or analogous features or elements of the inventions according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 4A:
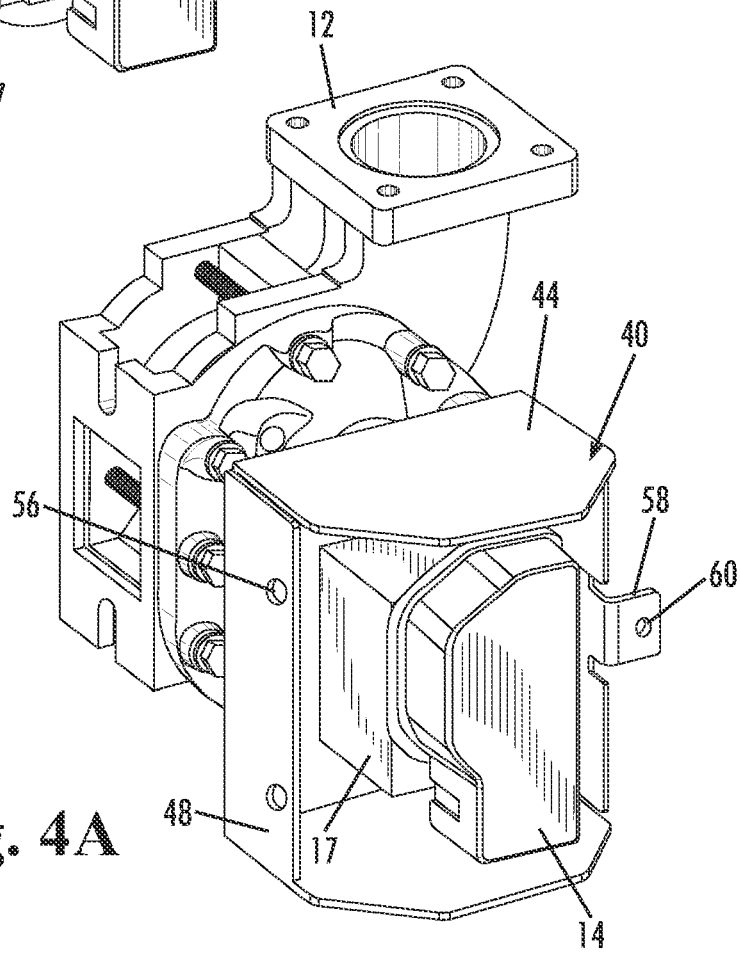
FIG. 4A is a perspective view of the first enclosure portion (shown in FIG. 1B) of the lockable enclosure mounted to the base plate.
Figure 4B:
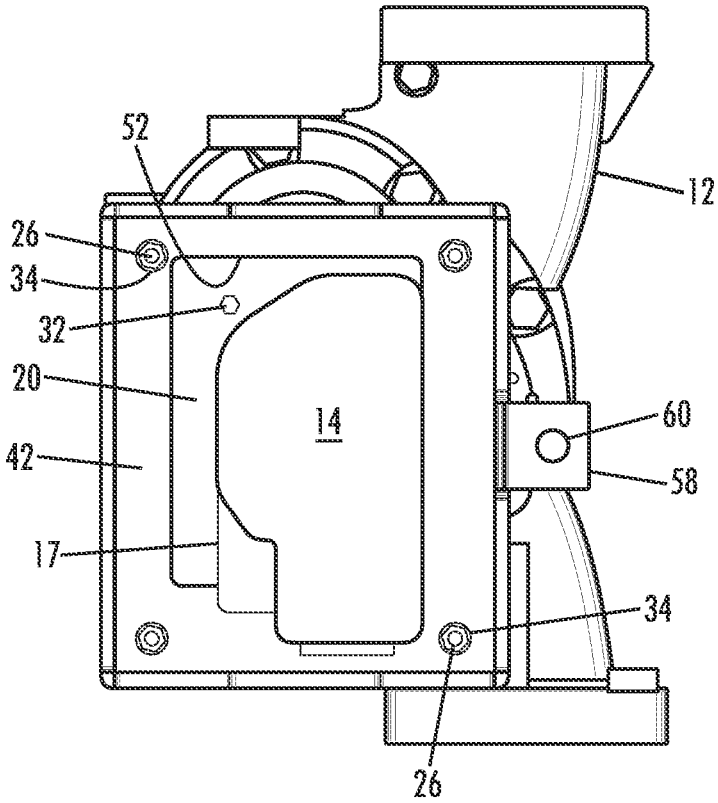
FIG. 4B is a side view of the assembly shown in FIG. 4A.
Figure 5:
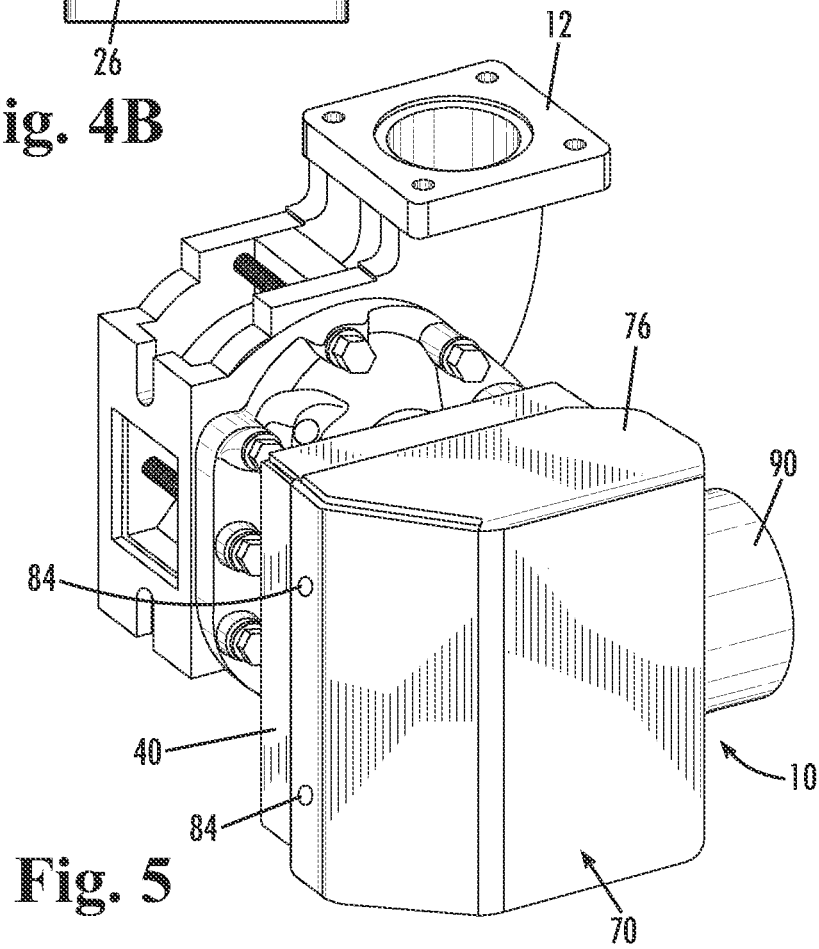
FIG. 5 is a perspective view of a second enclosure portion (shown in FIG. 1C) of the lockable enclosure detachably mounted to the first enclosure portion.
Figure 6:
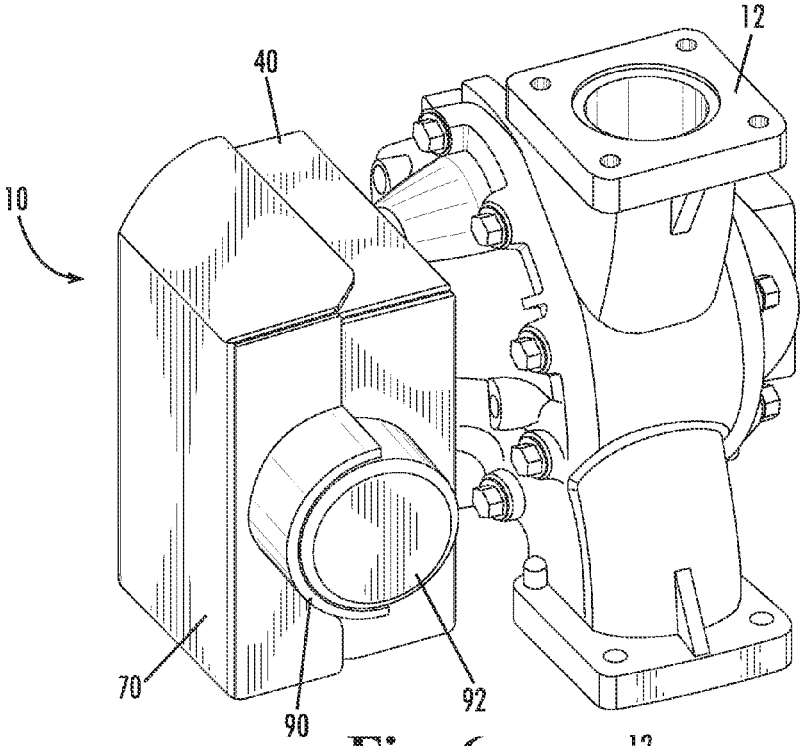
FIG. 6 is a front perspective view of the assembled lockable enclosure using components of FIGS. 1A, 1B and 1C, with a locking mechanism installed.
Figure 7:
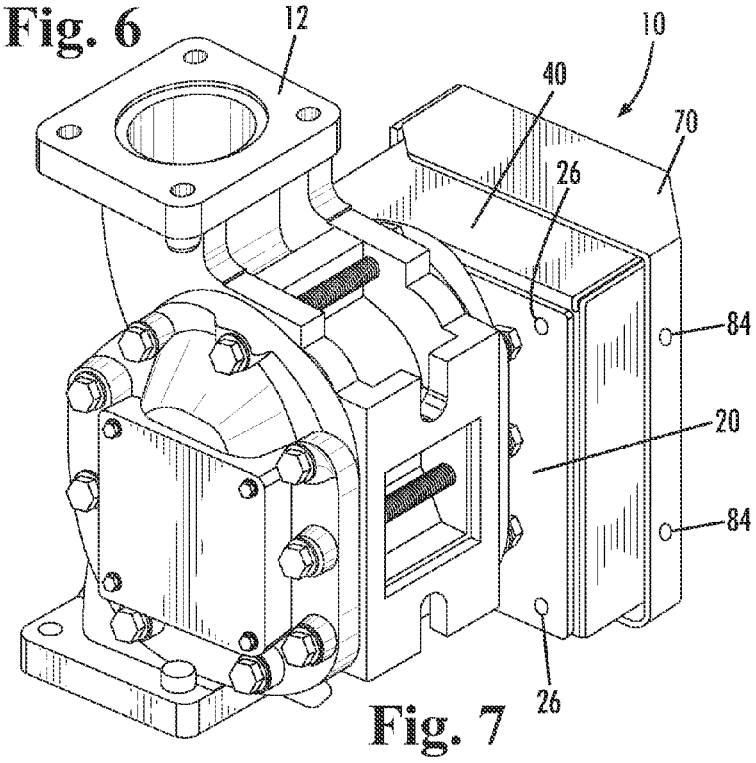
FIG. 7 is a rear perspective view of the assembled lockable enclosure shown in FIG. 6.

Referring to FIGS. 1A through 7, a first embodiment of a lockable enclosure 10 in accordance with the present inventions will be described. As best seen in FIGS. 6 and 7, lockable enclosure 10 is configured to fully surround and enclose a pulser 14 (FIG. 2) and pulser shaft (not shown) that connects pulser 14 to a corresponding fuel meter 12. Enclosure 10 includes a base plate 20 (FIG. 1A) that is configured to be attached to a housing 18 of fuel meter 12, a first enclosure portion 40 (FIG. 1B) that is configured to be mounted to base plate 20, a second enclosure portion 70 (FIG. 1C) that is configured to be removably mounted to first enclosure portion 40, and a locking mechanism 92 (FIG. 6) for detachably securing enclosure portions 40 and 70 together.

As best seen in FIG. 1A, base plate 20 includes a recess 22, a plurality of apertures 24, and a plurality of mounting studs 26 extending transversely from its front surface 28. Recess 22 extends inwardly from a peripheral edge such that base plate 20 can sidably receive a portion of housing 18 of fuel meter 12. Apertures 24 are disposed around recess 22 at locations corresponding with a plurality of threaded apertures 16 in fuel meter housing 18. Each mounting stud 26 is preferably positioned adjacent the outer periphery of base plate 20. In the embodiment shown, each mounting stud 26 includes an exposed threaded shank so that it may receive a threaded fastener, such as a nut 34 (FIG. 4B).

Figure 1B:
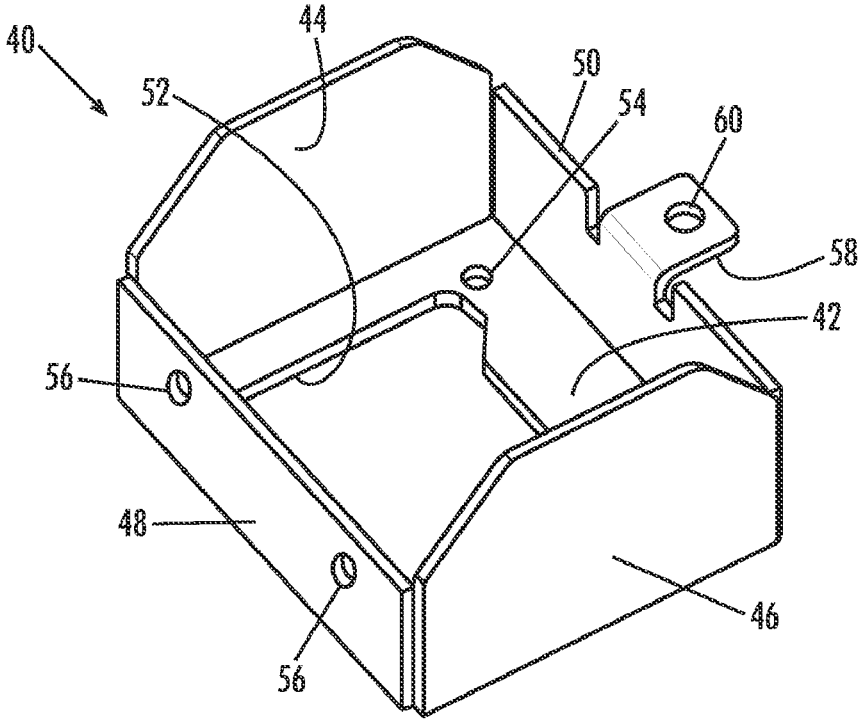

As best seen in FIG. 1B, first enclosure portion 40 includes a base wall 42, opposed top and bottom walls 44 and 46, respectively, and opposed rear and front walls 48 and 50, respectively. Each of top wall 44, bottom wall 46, rear wall 48 and front wall 50 extends upwardly and transversely from a corresponding peripheral edge of base wall 42, thereby forming a box-like structure. Base wall 42 defines an opening 52 that is configured to allow pulser 14 to pass therethrough. A plurality of apertures 54 are disposed around opening 52, their locations corresponding to the location of mounting studs 26 of base plate 20 such that each aperture 54 can slidably receive a corresponding mounting stud 26.

A pair of apertures 56 are defined adjacent a peripheral edge of rear wall 48 away from base wall 42. A locking plate 58 that defines an aperture 60 extends outwardly from a peripheral edge of front wall 50 away from base wall 42. In alternate embodiments of the lockable enclosure, first enclosure portion 40 and base plate 20 can be unitarily constructed. For example, an alternate embodiment of the lockable enclosure that is intended for installation at the time of initially assembling fuel meter 12 and pulser 14, rather than an "in the field" retrofit installation, may not require a separate base plate since the first enclosure portion can be installed on fuel meter 12 prior to installation of pulser 14.

Figure 1C:
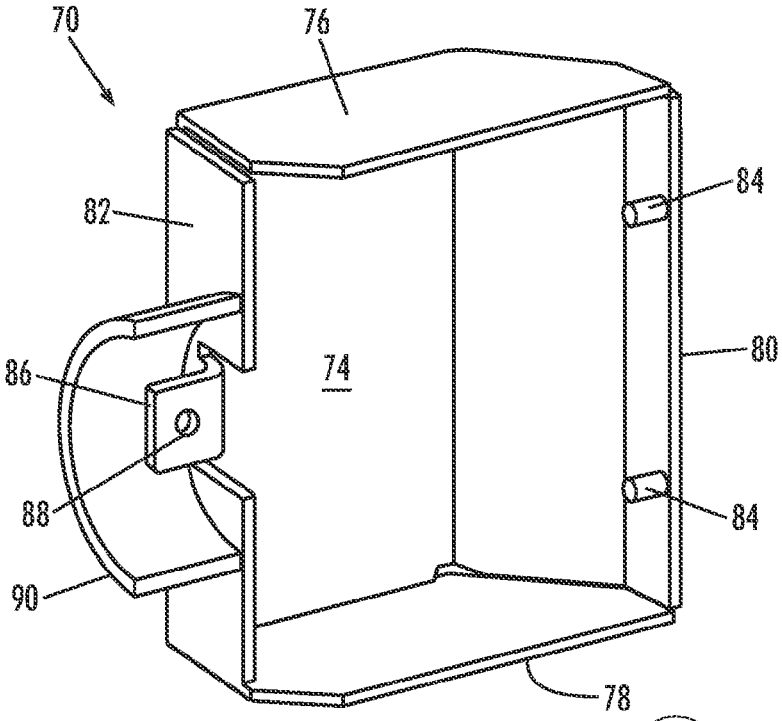

As best seen in FIG. 1C, second enclosure portion 70 includes an outer wall 74, opposed top and bottom walls 76 and 78, respectively, and opposed rear and front walls 80 and 82, respectively, thereby forming a box-like structure. A pair of mounting pins 84 extend inwardly from a peripheral edge of rear wall 80. A locking plate 86 defining an aperture 88 extends outwardly from a peripheral edge of front wall 82. Mounting pins 84 are positioned such that they are slidably received by apertures 56 of first enclosure portion 40. Locking plate 86 is positioned such that when second enclosure portion 70 is assembled with first enclosure portion 40, locking plates 58 and 86 are positioned adjacent each other and apertures 60 and 88 are aligned. So positioned, a locking mechanism 92 (FIG. 6) can be used to detachably secure first and second portions 40 and 70 together. In this embodiment, locking mechanism 92 is a "hockey puck" style lock as will be appreciated by one skilled in the art.

Figure 2:
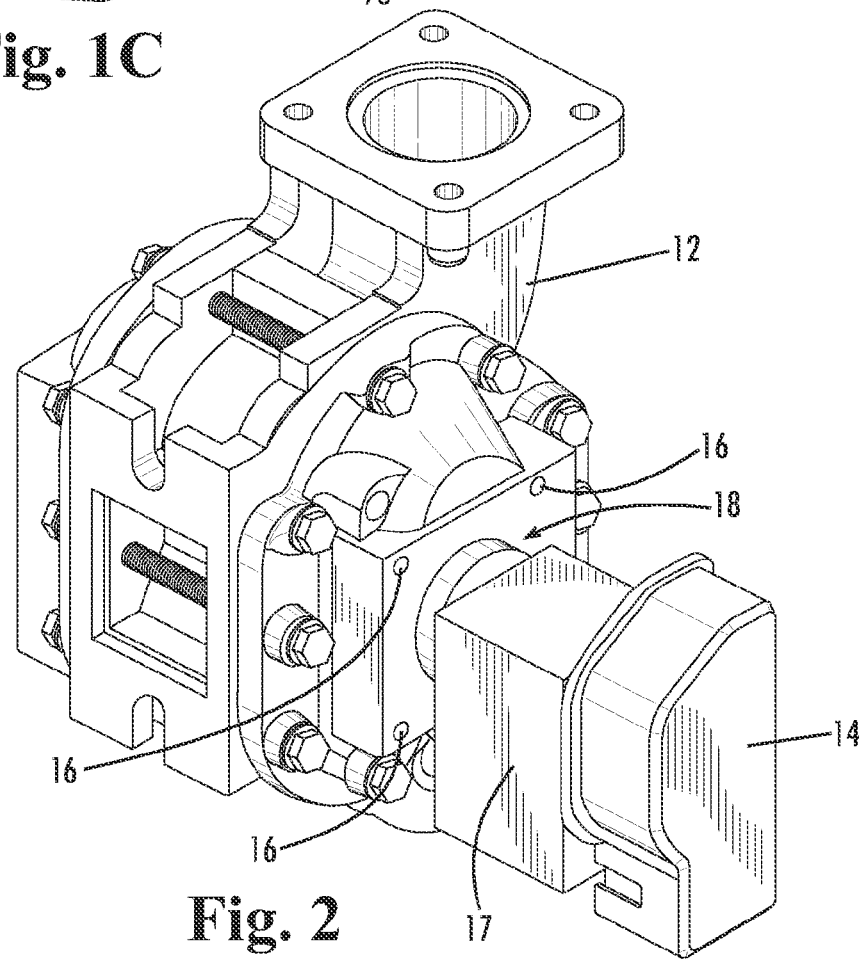
FIG. 2 is an example of a fuel meter and attached pulser on which the lockable enclosure shown in FIGS. 1A, 1B and 1C can be installed.
Figure 3:
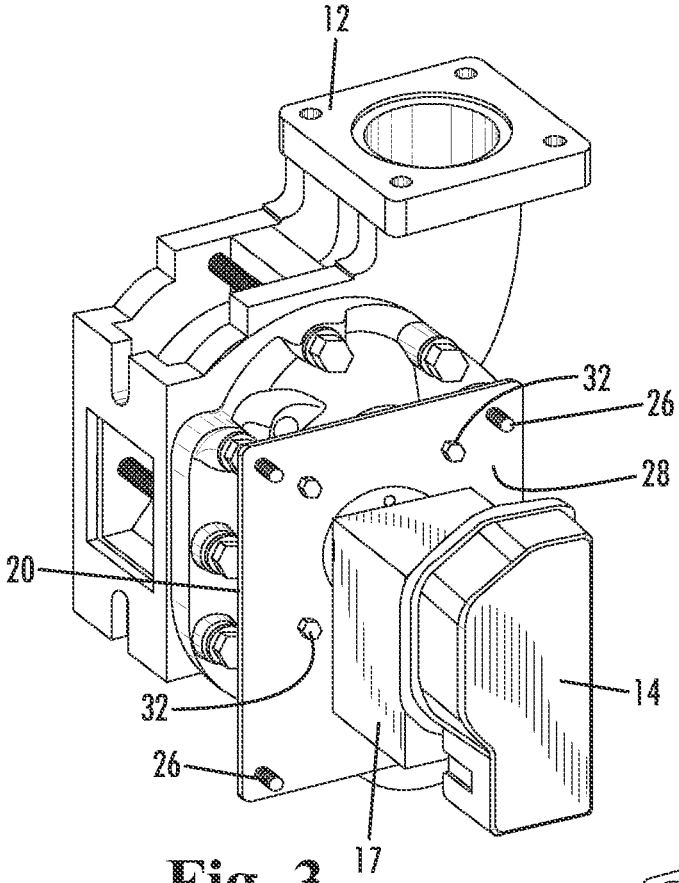
FIG. 3 is a perspective view of a base plate (shown in FIG. 1A) of the lockable enclosure attached to the fuel meter of FIG. 2.

Referring now to FIGS. 2 through 7, (and in contrast to the prior art locking covers that are fixedly mounted to the frame of the dispenser) lockable enclosure 10 is mounted to the housing of the fuel meter 12. As shown in FIG. 2, it is not uncommon for a small pulser shaft cover 17 to already be positioned over the pulser shaft (not shown) that connects pulser 14 to fuel meter 12. When installing lockable enclosure 10 onto fuel meter 12, base plate 20 is slidably positioned between housing 18 of fuel meter 12 and pulser shaft cover 17 by slidably receiving a portion of housing 18 in recess 22 of base plate 20. Base plate 20 is then manipulated until apertures 24 align with apertures 16 of fuel meter housing 18. As a result, threaded fasteners 32 can be used to attach base plate 20 to housing 18. When base plate 20 is attached to housing 18, mounting studs 26 on front surface 28 of base plate 20 will extend away from housing 18.

As best seen in FIGS. 4A and 4B, first enclosure portion 40 of lockable enclosure 10 is positioned adjacent front surface 28 of base plate 20 by passing pulser 14 and pulser shaft cover 17 through opening 52 defined by base wall 42. Base wall 42 is positioned adjacent base plate 20 by passing mounting studs 26 through apertures 54 defined in base wall 42. First enclosure portion 40 is then fixed adjacent base plate 20 by engaging the plurality of mounting studs 26 with a plurality of threaded nuts 34.

Referring now specifically to FIG. 5, second enclosure portion 70 of lockable enclosure 10 is removably mounted on first enclosure portion 40 by passing mounting pins 84 that extend inwardly from rear wall 80 through apertures 56 in rear wall 48 of first enclosure portion 40. Second enclosure portion 70 is then pivoted inwardly about mounting pins 84 until locking plate 86 abuts locking plate 58 of first enclosure portion 40. In this position, aperture 88 of locking plate 86 is aligned with aperture 60 of locking plate 58 such that second enclosure portion 70 can be detachably secured adjacent first enclosure portion 40 by passing the shank (not shown) of a locking mechanism 92 (FIG. 6) through the aligned apertures.

In the embodiment shown, a semi-cylindrical shroud 90 extends outwardly from front wall 82 of second enclosure portion 70 such that it is adjacent locking mechanism 92. As such, shroud 90 limits unauthorized access to locking mechanism 92 thereby decreasing the likelihood of tampering with locking mechanism 92. As shown in FIG. 6, lockable enclosure 10 restricts access to pulser 14 and the pulser shaft (not shown) by enclosing both components within the lockable enclosure. Note that second enclosure portion 70 can be subsequently detached by an authorized user should it be necessary to access pulser 14 or the pulser shaft for maintenance, etc. With second enclosure portion 70 removed, first enclosure portion 40 and base plate 20 can also be readily removed by an authorized user for maintenance purposes.

Figure 9:
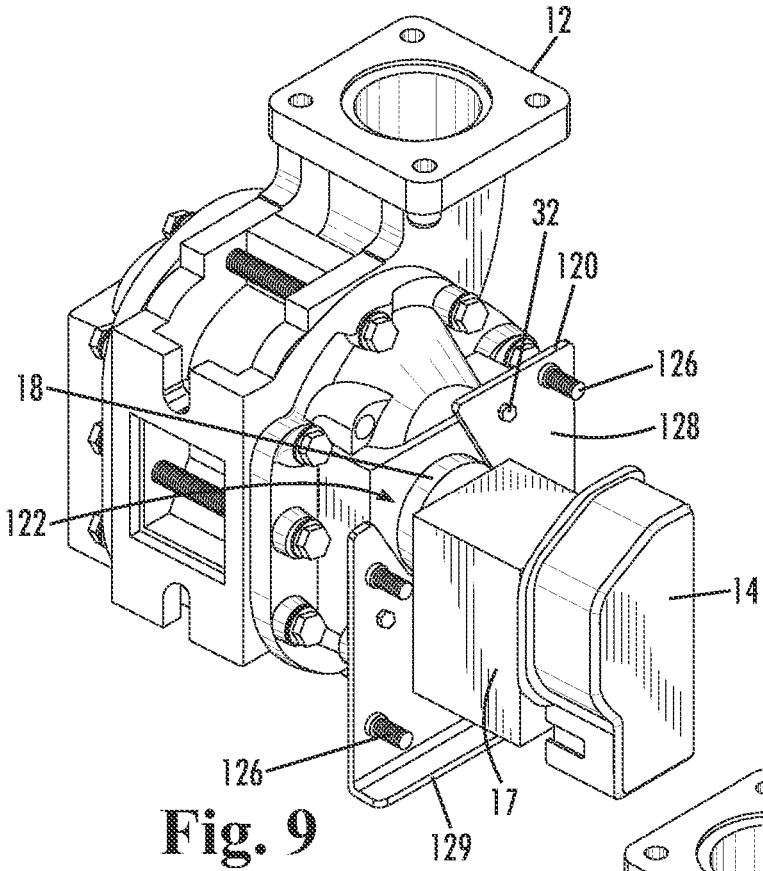
FIG. 9 is a perspective view of a base plate (shown in FIG. 8A) of the lockable enclosure attached to the fuel meter of FIG. 2.
Figure 10:
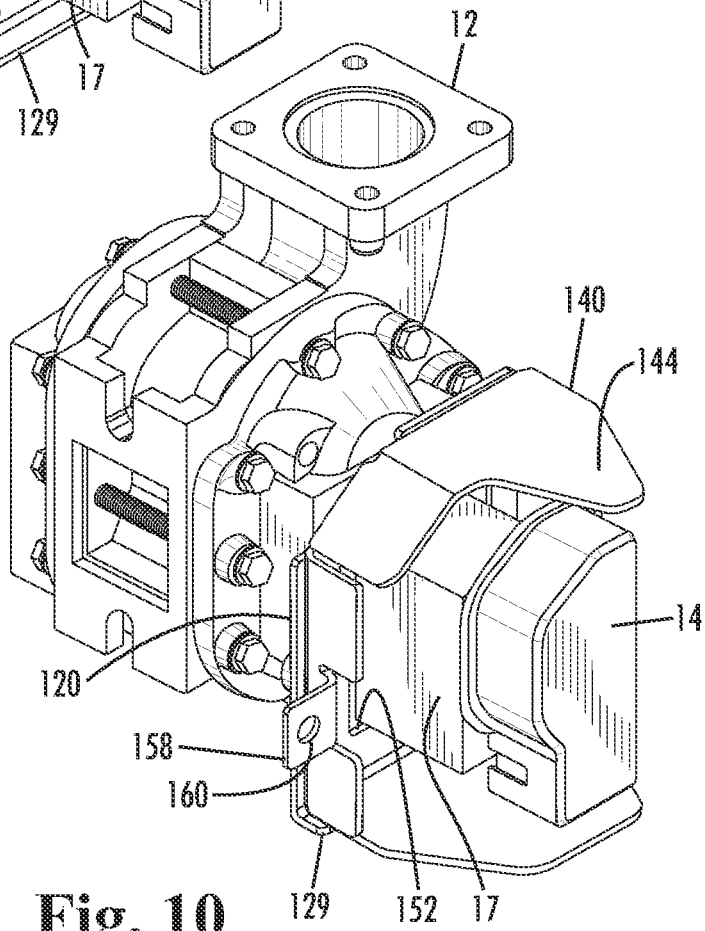
FIG. 10 is a perspective view of a first enclosure portion (shown in FIG. 8B) of the lockable enclosure mounted to the base plate.
Figure 11:
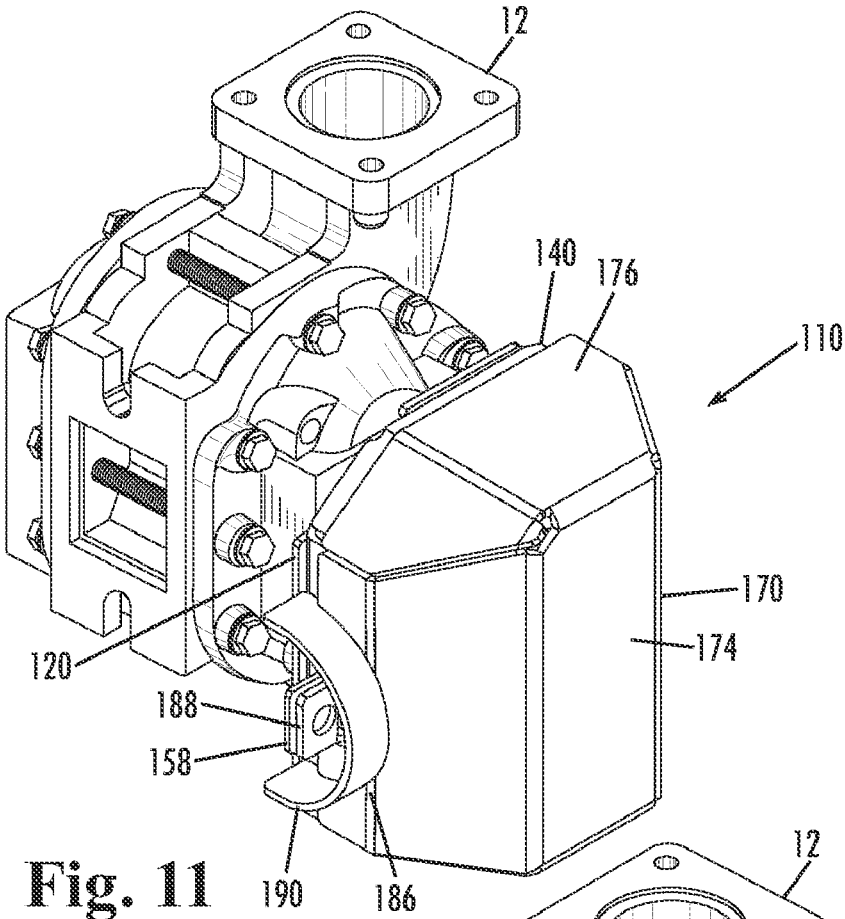
FIG. 11 is a perspective view of the lockable enclosure assembled using components shown in FIGS. 8C, 8D and 8E.
Figure 12:
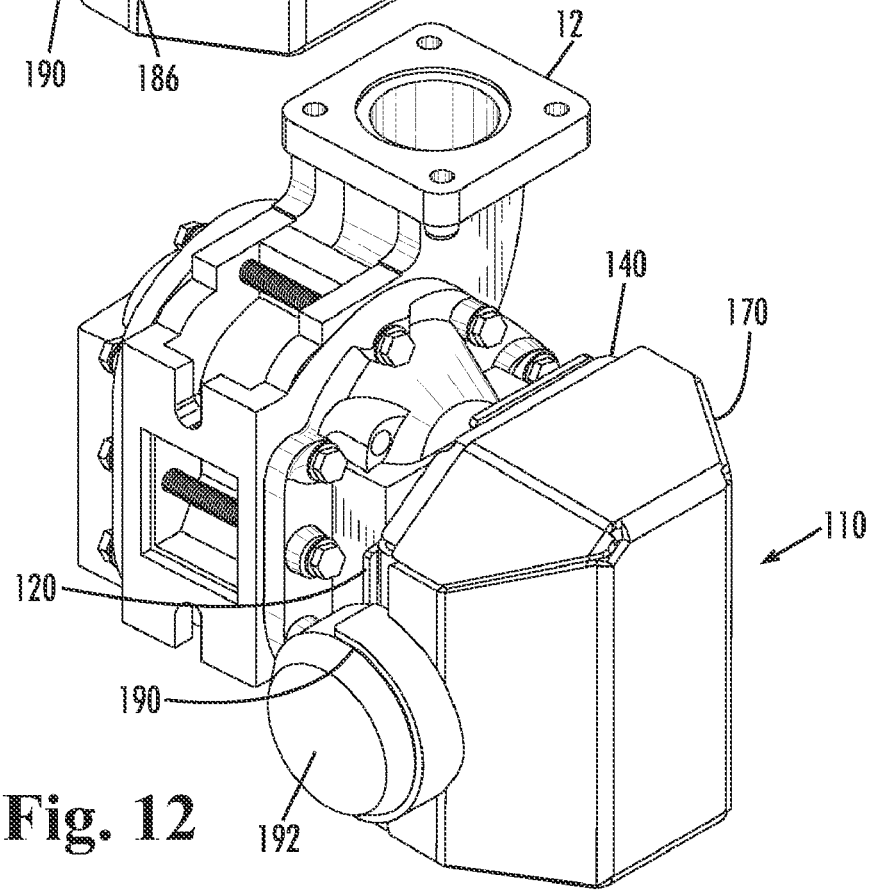
FIG. 12 is a perspective view similar to FIG. 11 but with a locking mechanism installed.
Figure 13:
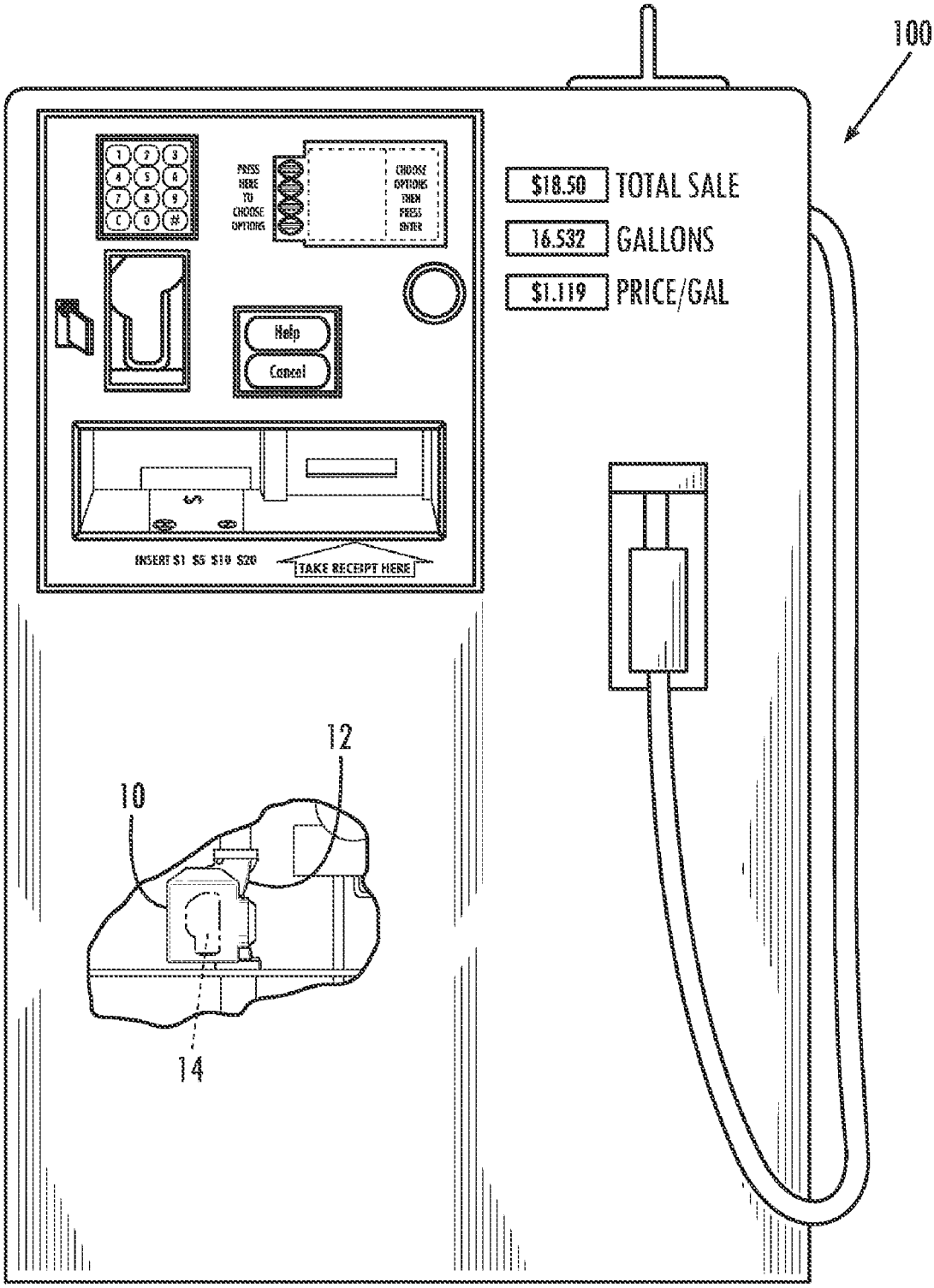
FIG. 13 is a partial cut-away view of a fuel dispenser including a lockable enclosure in accordance with the present invention protecting a pulser.

Referring now to FIGS. 8A through 12, an alternate embodiment of a lockable enclosure in accordance with the present invention will be described. Like the previous embodiment, this lockable enclosure 110 is mounted to the housing of the fuel meter 12. As best seen in FIGS. 11 and 12, lockable enclosure 110 is configured to fully enclose a pulser 14 (FIG. 9) and pulser shaft (not shown) that connects pulser 14 to a corresponding fuel meter 12. Lockable enclosure 110 includes a base plate 120 (FIG. 8A) that is configured to be attached to housing 18 of fuel meter 12, a first enclosure portion 140 (FIG. 8B) that is configured to be attached to base plate 120, a second enclosure portion 170 (FIG. 8C) that is configured to be removably secured to first enclosure portion 140, and a locking mechanism 192 (FIG. 12) for detachably securing enclosure portions 140 and 170 together.

Figure 8A:
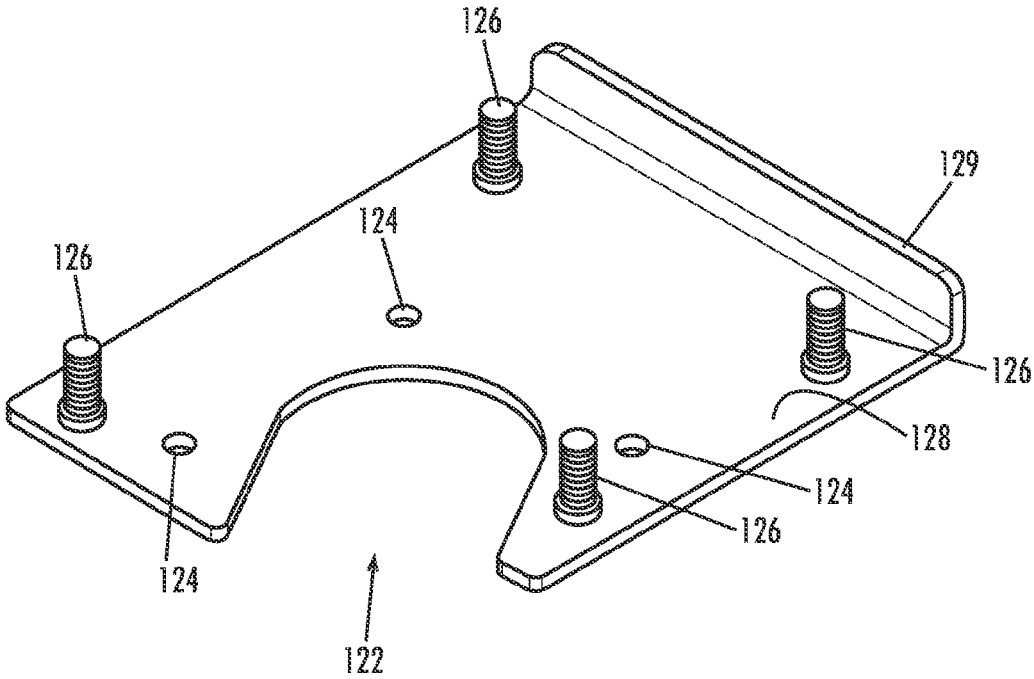
FIGS. 8A, 8B, 8C, 8D and 8E are views of various components of an alternate embodiment of a lockable enclosure in accordance with the present inventions.

As best seen in FIG. 8A, base plate 120 includes a recess 122, a plurality of apertures 124, and a plurality of mounting studs 126 extending transversely from its front surface 128. Recess 122 extends inwardly from a peripheral edge such that base plate 120 can slidably receive a portion of housing 18 of fuel meter 12. Apertures 124 are disposed around recess 122 at positions corresponding with a plurality of threaded apertures 16 in fuel meter housing 18. Each mounting stud 126 is preferably positioned adjacent the outer periphery of base plate 120. In the embodiment shown, each mounting stud 126 includes an exposed threaded shank so that it may receive a threaded fastener, such as a nut (not shown). In addition, base plate 120 includes a lip 129 extending outwardly from front surface 128 along the bottom peripheral edge of the plate.

Figure 8B:
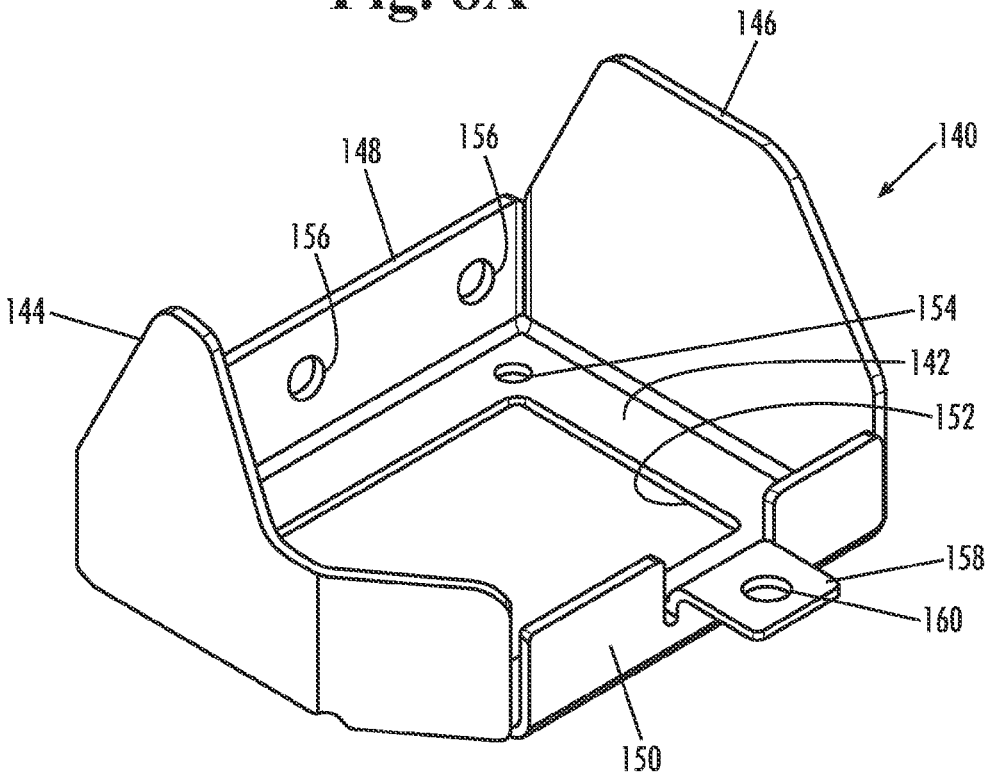

As best shown in FIG. 8B, first enclosure portion 140 includes a base wall 142, opposed top and bottom walls 144 and 146, respectively, and opposed rear and front walls 148 and 150, respectively. Each of top wall 144, bottom wall 146, rear wall 148 and front wall 150 extends upwardly and transversely from a corresponding peripheral edge of base wall 142, thereby forming a box-like structure. Base wall 142 defines an opening 152 that is configured to allow pulser 14 to pass therethrough. A plurality of apertures 154 are disposed around opening 152, their locations corresponding to the locations of mounting studs 126 on base plate 120.

A trio of apertures 156 (only two are shown) are defined adjacent a peripheral edge of rear wall 148 away from base wall 142. A locking plate 158 that defines an aperture 160 extends outwardly from a peripheral edge of front wall 150 away from base wall 142. In alternate embodiments, first enclosure portion 140 and base plate 120 are unitarily constructed. For example, an alternate embodiment of the lockable enclosure that is intended for installation at the time of initially assembling fuel meter 12 and pulser 14, rather than an "in the field" retrofit installation, may not require a separate base plate since the first enclosure portion can be installed on fuel meter 12 prior to installation of pulser 14.

Figure 8C:
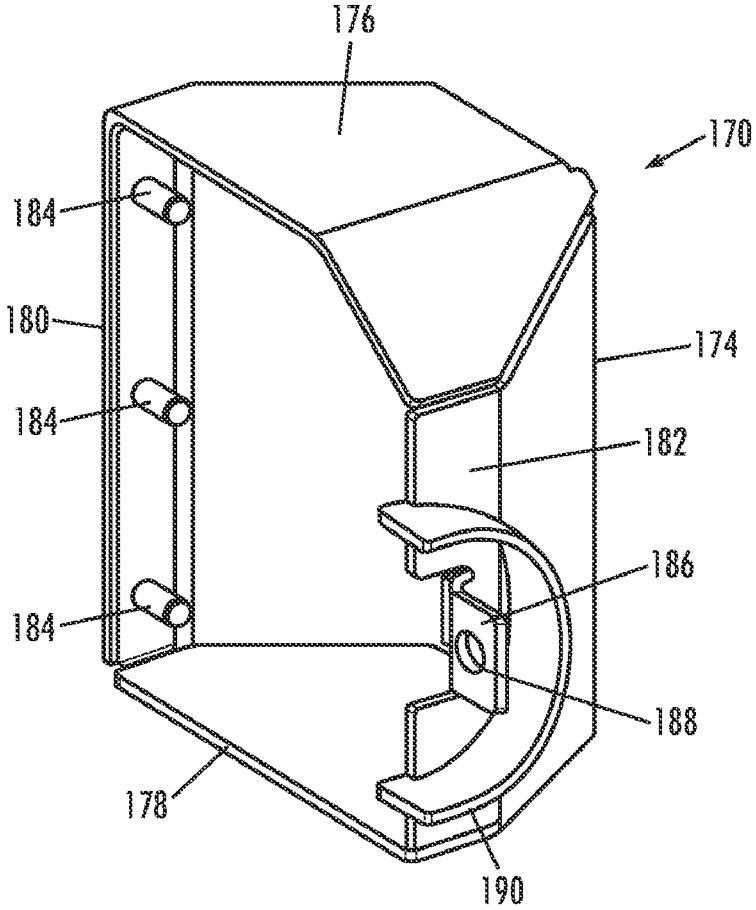
Figure 8D:
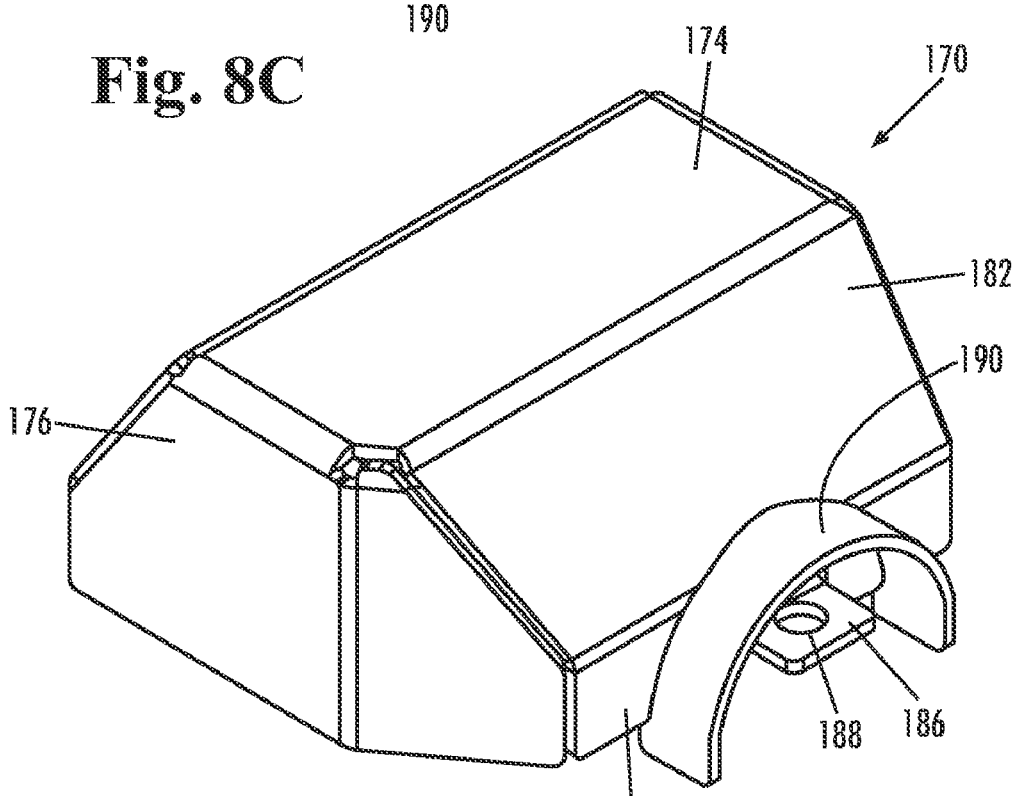
Figure 8E:
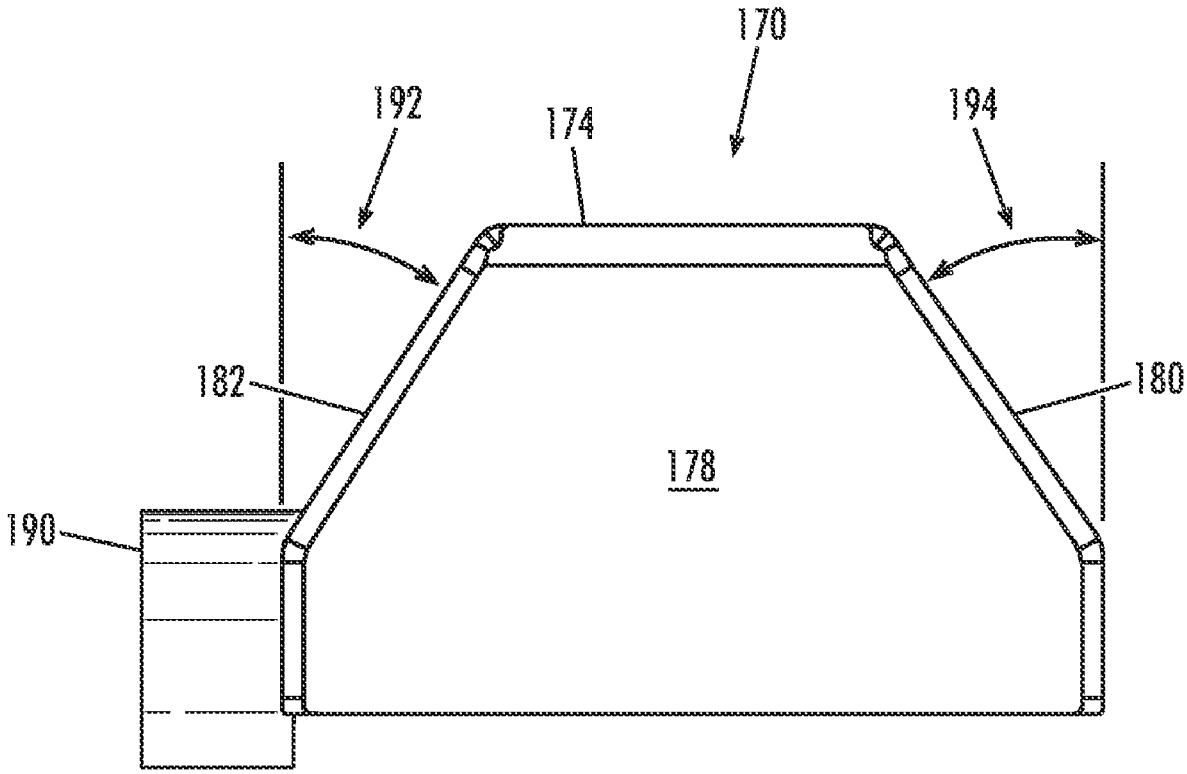

As best seen in FIGS. 8C through 8E, second enclosure portion 170 includes an outer wall 174, opposed top and bottom walls 176 and 178, respectively, and opposed rear and front walls 180 and 182, respectively, thereby forming a box-like structure. Multiple mounting pins 184 extend inwardly from a peripheral edge of rear wall 180 and a locking plate 186 defining an aperture 188 extends outwardly from a peripheral edge of front wall 182. Mounting pins 184 are positioned such that they are slidably received by apertures 156 defined by rear wall 148 of first enclosure portion 140. Locking plate 186 is positioned such that when second enclosure portion 170 is assembled with first enclosure portion 140, locking plates 158 and 186 are positioned adjacent each other and apertures 160 and 188 are aligned. So positioned, a locking mechanism 192 (FIG. 12) can be used to detachably secure enclosure portions 140 and 170 together.

As best seen in FIG. 8E, rear wall 180 and front wall 182 each include parallel portions and converging angled portions 181 and 183, respectively. As shown, the angled portions define respective angles 194 and 192 with the parallel portions. For the preferred embodiment shown, angles 194 and 192 are each approximately 32°.

Referring now to FIGS. 9 through 12, installation of lockable enclosure 110 on fuel meter 12 is discussed. As shown in FIG. 9, it is not uncommon for a small pulser shaft cover 17 to already be positioned over the pulser shaft (not shown) that connects pulser 14 to fuel meter 12. When installing lockable enclosure 110 onto fuel meter 12, base plate 120 is slidably positioned between housing 118 of fuel meter 12 and pulser shaft cover 17 by slidably receiving a portion of housing 18 in recess 122 of base plate 120, as shown in FIG. 9. Base plate 120 is then manipulated until apertures 124 align with apertures 16 of fuel meter housing 18 such that threaded fasteners 32 can be used to attach base plate 120 to housing 18. When base plate 120 is attached to housing 18, mounting studs 126 on front surface 128 of base plate 120 will extend away from housing 18.

As best seen in FIG. 10, first enclosure portion 140 of lockable enclosure 110 is positioned adjacent front surface 128 of base plate 120 by passing pulser 14 and pulser shaft cover 17 through opening 152 defined by base wall 142. Base wall 142 is positioned adjacent base plate 120 by passing mounting studs 126 through aperture 154 defined in base wall 142. First enclosure portion 140 is then mounted adjacent base plate 20 by engaging mounting studs 126 with a plurality of threaded nuts (not shown).

Referring now to FIG. 11, second enclosure portion 170 of lockable cover 110 is mounted on first enclosure portion 140 by passing mounting pins 184 that extend inwardly from rear wall 180 through apertures 156 defined in rear wall 148 of first enclosure portion 140. Second enclosure portion 170 is then pivoted inwardly about mounting pins 184 until locking plate 186 abuts locking plate 158 disposed on first enclosure portion 140. In this position, aperture 188 of locking plate 186 is aligned with aperture 160 of locking plate 158 such that second enclosure portion 170 can be detachably secured to first portion 140 by passing the shank (not shown) of a locking mechanism 192 through the aligned apertures.

In the embodiment shown, a semi-cylindrical shroud 190 extends outwardly from front wall 182 of second enclosure portion 170 such that it is adjacent locking mechanism 192. As such, shield 190 limits access to locking assembly 192, thereby decreasing the likelihood of tampering with locking mechanism 192. Lockable enclosure 110 restricts access to pulser 14 and the pulser shaft (not shown) by enclosing both components. Note that second enclosure portion 170 can be subsequently removed by an authorized user should it be necessary to access pulser 14 or the pulser shaft for maintenance, etc. With the second enclosure portion 170 removed, first enclosure portion 140 and base plate 120 can also be readily removed by an authorized user for maintenance purposes.

Referring now to FIG. 15, lockable enclosure 10, as shown in FIGS. 1A through 7, is installed in a fuel dispenser 100 including a pulser 14 that measures and reports the amount of fuel being dispensed. As previously noted, the fasteners that secure lockable enclosure 10 to fuel meter 12 are located inside lockable enclosure 10, which inhibits their removal by a thief. In addition, pulser 14 and pulser shaft (not shown) are entirely enclosed, preventing access by an elongated object. Thus, it can be seen that the present invention overcomes the problems with the prior art.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole and in part. Furthermore, those of ordinary skill in the art will appreciate that the foregoing description is by way of example only, and is not intended to limit the invention so further described in such appended claims. Therefore, the spirit and scope of the appended claims should be limited to the description of the preferred versions contained therein.

What is claimed is:

1. A lockable enclosure for protecting a pulser of a fuel dispenser having a pulser shaft connecting the pulser to a fuel meter for measuring and reporting the amount of fuel being measured, the enclosure comprising:

a first enclosure portion fixedly mounted within the fuel dispenser adjacent to the fuel meter, the first portion including a base wall, a top wall, a bottom wall, a rear wall, a front wall, a first locking plate extending outwardly from the front wall and a mounting aperture defined by the rear wall; and a second enclosure portion detachably mounted to the first portion, the second portion including an outer wall, a top wall, a bottom wall, a rear wall, a front wall, a second locking plate extending outwardly from the front wall and a mounting pin extending inwardly from the rear wall, wherein when the mounting pin of the second enclosure portion is removably received in the mounting aperture defined by the rear wall of the first enclosure portion and the first and second locking plates are positioned adjacent each other to enclose the pulser and pulser shaft within the enclosure.

2. The lockable enclosure of claim 1, wherein the first enclosure portion is fixedly mounted to the fuel meter.

3. The lockable enclosure of claim 1, further including a locking device for detachably securing the first locking plate to the second locking plate.

4. The lockable enclosure of claim 3, further comprising a shroud extending outwardly from the front wall of the second portion, the shroud being configured to partially surround the locking device.

5. The lockable enclosure of claim 1, wherein the base wall of the first enclosure portion defines an opening that is configured to allow the pulser to pass therethrough.

6. The lockable enclosure of claim 5, further comprising a base plate that is attached to the fuel meter by at least one fastener, wherein the first enclosure portion is mounted to the base plate such that the base plate is disposed between the fuel meter and the first enclosure portion.

7. The lockable enclosure of claim 6, wherein the base plate further comprises a recess that extends inwardly from a peripheral edge of the base plate, the recess being configured to receive the pulser shaft such that the base plate can be positioned adjacent the fuel meter.

8. The lockable enclosure of claim 7, further comprising at least one mounting aperture defined by the base wall of the first enclosure portion, at least one mounting stud extending outwardly from the base plate and through the mounting aperture of the base wall, and at least one fastener that engages the mounting stud such that the first enclosure portion is mounted to the base plate.

9. The lockable enclosure of claim 8, wherein the fasteners that attach the base plate adjacent to the fuel meter and the first enclosure portion to the base plate are disposed within the enclosure when the second enclosure portion is removably mounted to the first enclosure portion.

10. The lockable enclosure of claim 1, wherein the top wall, the bottom wall, the rear wall and the front wall of the second enclosure portion overlap the top wall, the bottom wall, the rear wall and the front wall of the first enclosure portion, respectively, when second enclosure portion is removably mounted to the first enclosure portion.

11. The lockable enclosure of claim 1, wherein the first enclosure portion is attached directly to a housing of the fuel meter.

12. A lockable enclosure for protecting a pulser of a fuel dispenser having a pulser shaft connecting the pulser to a fuel meter for measuring and reporting the amount of fuel being measured, the enclosure comprising:

a first enclosure portion fixedly mounted within the fuel dispenser adjacent to the fuel meter, the first enclosure portion including a base wall defining an opening, a first locking plate extending outwardly from the first enclosure portion and a mounting aperture defined by the first enclosure portion; and a second enclosure portion removably mounted on the first enclosure portion, the second enclosure portion including an outer wall, a second locking plate extending outwardly from the second enclosure portion and a mounting pin disposed on the second enclosure portion, wherein when the mounting pin of the second enclosure portion is removably received in the mounting aperture defined by the first enclosure portion and the first and second locking plates are positioned adjacent each other to enclose the pulser and pulser shaft within the enclosure.

13. The lockable enclosure of claim 12, wherein the first enclosure portion is fixedly mounted to the fuel meter.

14. The lockable enclosure of claim 12, further including a locking device for detachably securing the first locking plate to the second locking plate.

15. The lockable enclosure of claim 12, wherein the opening defined by the base wall of the first enclosure portion is configured to allow the pulser to pass therethrough.

16. The lockable enclosure of claim 15, further comprising a base plate that is attached to the fuel meter by at least one fastener, wherein the first enclosure portion is mounted on the base plate such that the base plate is disposed between the fuel meter and the first enclosure portion.

17. The lockable enclosure of claim 16, wherein the base plate further comprises a recess that extends inwardly from a peripheral edge of the base plate, the recess being configured to receive the pulser shaft such that the base plate can be positioned adjacent the fuel meter.

18. The lockable enclosure of claim 17, further comprising at least one mounting aperture defined by the base wall of the first enclosure portion, at least one mounting stud extending outwardly from the base plate and through the mounting aperture of the base wall, and at least one fastener that engages the mounting stud such that the first enclosure portion is mounted to the base plate.

19. The lockable enclosure of claim 12, wherein the first enclosure portion is directly attached to a housing of the fuel meter.

20. A lockable enclosure for protecting a pulser of a fuel dispenser having a pulser shaft connecting the pulser to a fuel meter for measuring and reporting the amount of fuel being measured, the enclosure comprising:

a base plate fixedly mounted within the fuel dispenser adjacent to the fuel meter;

a first enclosure portion mounted on the base plate, the first enclosure portion including a base wall defining an opening; and a second enclosure portion removably mounted on the first enclosure portion, wherein when the second enclosure portion is detachably secured to the first enclosure portion to enclose the pulser and pulser shaft within the enclosure.

21. The lockable enclosure of claim 20, wherein the base plate is fixedly mounted to the fuel meter.

22. The lockable enclosure of claim 20, further comprising:

a first locking plate extending outwardly from the first enclosure portion and a mounting aperture defined by the first enclosure portion; and a second locking plate extending outwardly from the second enclosure portion and a mounting pin disposed on the second enclosure portion, wherein the mounting pin of the second enclosure portion is removably received in the mounting aperture defined by the first enclosure portion and the first and second locking plates are adjacent each other.

23. The enclosure of claim 20, further including a locking device for detachably securing the first and second enclosure portions together.

24. The enclosure of claim 20, wherein the opening defined by the base wall of the first enclosure portion is configured to allow the pulser to pass therethrough.

* * * * *